US012504258B2

(12) United States Patent
Saad

(10) Patent No.: US 12,504,258 B2
(45) Date of Patent: Dec. 23, 2025

(54) BALLISTIC HEADWEAR SYSTEM

(71) Applicant: Daniel F. Saad, Greer, SC (US)

(72) Inventor: Daniel F. Saad, Greer, SC (US)

( * ) Notice: Subject to any disclaimer, the term of this patent is extended or adjusted under 35 U.S.C. 154(b) by 0 days.

(21) Appl. No.: 18/364,077

(22) Filed: Aug. 2, 2023

(65) Prior Publication Data

US 2025/0044061 A1 Feb. 6, 2025

(51) Int. Cl.

| | |
|---|---|
| ***F41H 1/04*** | (2006.01) |
| ***A42B 1/0182*** | (2021.01) |
| ***A42B 1/08*** | (2006.01) |
| ***A42B 1/241*** | (2021.01) |

(52) U.S. Cl.

CPC ..... *F41H 1/04* (2013.01); *A42B 1/08* (2013.01); *A42B 1/241* (2013.01); *A42B 1/0182* (2021.01)

(58) Field of Classification Search

CPC .... A42B 1/04; A42B 1/06; A42B 1/08; A42B 1/24; A42B 1/241; A42B 1/0189; A42B 1/019; A42B 1/205; A42B 1/208; F41H 1/02; F41H 5/0471; F41H 5/0485

See application file for complete search history.

(56) References Cited

U.S. PATENT DOCUMENTS

| | | | | |
|---|---|---|---|---|
| 3,958,276 | A * | 5/1976 | Clausen | F41H 1/02 2/2.5 |
| 5,359,733 | A * | 11/1994 | Brannon | A42B 1/248 2/209.13 |
| 5,729,830 | A * | 3/1998 | Luhtala | F41H 1/00 2/200.1 |
| 6,499,145 | B1 | 12/2002 | Kates | |
| 7,937,778 | B1 | 5/2011 | Norton | |
| 8,613,114 | B1 | 12/2013 | Olivares Velasco | |
| 8,739,316 | B1 | 6/2014 | Norton | |
| 8,819,867 | B1 * | 9/2014 | Boada | A42B 1/24 2/171.2 |
| 10,697,736 | B2 | 6/2020 | Saad | |
| 2004/0034903 | A1 * | 2/2004 | Blair | A42B 3/003 2/410 |
| 2005/0268382 | A1 * | 12/2005 | Epling | A42B 1/0189 2/411 |
| 2011/0307997 | A1 | 12/2011 | Blair | |
| 2014/0007324 | A1 | 1/2014 | Svehaug | |
| 2014/0060302 | A1 * | 3/2014 | Fulcheri | F41H 5/0478 156/60 |
| 2014/0201885 | A1 * | 7/2014 | Rackerby | A42B 1/08 2/181 |
| 2014/0230133 | A1 * | 8/2014 | Roberts | A42B 3/12 2/411 |
| 2018/0055127 | A1 * | 3/2018 | Plon | A42B 1/006 |
| 2019/0353463 | A1 * | 11/2019 | Saad | A42B 1/205 |

FOREIGN PATENT DOCUMENTS

| | | | | |
|---|---|---|---|---|
| GB | 752303 | A * | 7/1956 | A42B 1/08 |

* cited by examiner

*Primary Examiner* — Aiying Zhao

(74) *Attorney, Agent, or Firm* — Dority & Manning, P.A.

(57) ABSTRACT

A ballistic garment includes a fabric hat and an insert received within an interior of the fabric hat. The insert includes a plurality of flexible ballistic sheets mounted together to collectively form the insert. The insert further includes a rear bottom edge. The insert is configured such that the rear bottom edge of the insert extends to an occipital ridge of a wearer when the insert is on the wearer.

17 Claims, 5 Drawing Sheets

BALLISTIC HEADWEAR SYSTEM

FIELD OF THE INVENTION

The present subject matter relates generally to ballistic garments, namely flexible ballistic headwear.

BACKGROUND OF THE INVENTION

Firearms are a known hazard to law enforcement officers. In 2016, one hundred and forty-three law enforcement officers died in the line of duty, and sixty-six of these deaths were attributed to lethal gunshot wounds. Law enforcement officers have worn ballistic vests for decades to reduce the risk of lethal gunshot wounds, but ballistic vests have limitations. In particular, ballistic vests protect torsos while leaving other body parts vulnerable to gunshot wounds.

The head is particularly vulnerable to gunshots, and known ballistic vests offer no head protection. Gunshot wounds to the head are associated with high risk of death or grave disability due to irreversible brain tissue damage. Ballistic helmets are available that can reduce head damage from gunshot wounds. However, police departments frequently limit the use of ballistic helmets because they can appear aggressive or militaristic to the public. Thus, ballistic helmets are generally only issued to Special Weapons and Tactics (SWAT) units in police departments. In addition, ballistic helmets can be heavy and cumbersome for constant wear while on duty.

BRIEF DESCRIPTION OF THE INVENTION

Aspects and advantages of the invention will be set forth in part in the following description, or may be apparent from the description, or may be learned through practice of the invention.

In general, the present subject matter provides a ballistic garment that includes a fabric hat and an insert received within an interior of the fabric hat. The insert includes a plurality of flexible ballistic sheets mounted together to collectively form the insert. The flexible ballistic sheets may protect the wearer from injuries and may be resistant to penetration by projectiles, such as bullets. A rear bottom edge of the insert may extend to an occipital ridge of a wearer. Thus, the insert may cover vulnerable portions of the head, including up to where the spine meets the skull. Moreover, such extension of the insert may advantageously increase stability of the insert on the wearer by engaging the occipital ridge. For instance, the rear bottom edge of the insert may tuck under the occipital ridge to assist with secure wearing of the insert and thus allow greater movement and activity without undesirable movement of the insert relative to the wearer.

In an example embodiment, a ballistic garment includes a fabric hat and an insert received within an interior of the fabric hat, the insert comprising a plurality of flexible ballistic sheets mounted together to collectively form the insert, the insert further comprising a rear bottom edge, the insert configured such that the rear bottom edge of the insert extends to an occipital ridge of a wearer when the insert is on the wearer.

In a first example aspect, the fabric hat includes a rear bottom edge. The fabric hat is configured such that the rear bottom edge of the fabric hat covers the rear bottom edge of the insert.

In a second example aspect, the insert is removable from the interior of the fabric hat.

In a third example aspect, each of the plurality of flexible ballistic sheets defines at least one slit. Opposite edges of the plurality of flexible ballistic sheets at the at least one slit are positioned in overlap such that each of the plurality of flexible ballistic sheets is curved. The plurality of flexible ballistic sheets are nested together.

In a fourth example aspect, the opposite edges of each of the plurality of flexible ballistic sheets define an overlap joint. The plurality of flexible ballistic sheets are nested together in a stack. The overlap joint of each the plurality of flexible ballistic sheets is offset from the overlap joint of adjacent ballistic sheets within the stack of flexible ballistic sheets.

In a fifth example aspect, a thickness of the insert formed by the plurality of flexible ballistic sheets is no less than four millimeters (4 mm) and no greater than eight millimeters (8 mm).

In a sixth example aspect, the plurality of flexible ballistic sheets comprises no less than fifteen (15) flexible ballistic sheets.

In a seventh example aspect, each of the plurality of flexible ballistic sheets comprises ultra-high-molecular-weight polyethylene fibers.

In an eighth example aspect, the insert conforms to the National Institute of Justice (NIJ) Type IIIa standard.

In a ninth example aspect, the insert formed by the plurality of flexible ballistic sheets covers anterior, lateral, and posterior skull bones as well as the occipital ridge when the insert is on a wearer.

In a tenth example aspect, the plurality of flexible ballistic sheets are distributed three-hundred and sixty degrees (360°) around the interior of the fabric hat.

In an eleventh example aspect, the plurality of flexible ballistic sheets may be mounted together by adhesive or thermal bonding.

In a twelfth example aspect, the insert defines a pair of ear notches on opposite sides of the insert.

Each of the example aspects recited above may be combined with one or more of the other example aspects recited above in certain embodiments. For instance, all of the twelve example aspects recited above, i.e., the first through twelfth examples aspects, may be combined with one another in some embodiments. As another example, any combination of two, three, four, five, or more of the twelve example aspects recited above may be combined in other embodiments. Thus, the example aspects recited above may be utilized in combination with one another in some example embodiments. Alternatively, the example aspects recited above may be individually implemented in other example embodiments. Accordingly, it will be understood that various example embodiments may be realized utilizing the example aspects recited above.

In another example embodiment, a ballistic garment includes a fabric hat with a rear bottom edge. The fabric hat is configured such that the rear bottom edge of the fabric hat covers an occipital ridge of the wearer when the fabric hat is on the wearer. An insert is removably received within an interior of the fabric hat. The insert includes a plurality of flexible ballistic sheets thermally bonded together to collectively form the insert. The insert further includes a rear bottom edge positioned at the rear bottom edge of the fabric hat such that the rear bottom edge of the insert extends to the occipital ridge of the wearer when the insert is on the wearer. Each of the plurality of flexible ballistic sheets defines at least one slit. Opposite edges of the plurality of flexible ballistic sheets at the at least one slit are positioned in overlap such that each of the plurality of flexible ballistic sheets is curved. The plurality of flexible ballistic sheets are nested together.

In a thirteenth example aspect, the opposite edges of each of the plurality of flexible ballistic sheets defines an overlap joint. The plurality of flexible ballistic sheets are nested together in a stack. The overlap joint of each the plurality of flexible ballistic sheets is offset from the overlap joint of adjacent ballistic sheets within the stack of flexible ballistic sheets.

In a fourteenth example aspect, a thickness of the insert formed by the plurality of flexible ballistic sheets is no less than four millimeters (4 mm) and no greater than eight millimeters (8 mm).

In a fifteenth example aspect, the plurality of flexible ballistic sheets comprises no less than fifteen flexible ballistic sheets.

In a sixteenth example aspect, the plurality of flexible ballistic sheets are distributed three-hundred and sixty degrees (360°) around the interior of the fabric hat.

In a seventeenth example aspect, the insert defines a pair of ear notches on opposite sides of the insert.

Each of the example aspects recited above may be combined with one or more of the other example aspects recited above in certain embodiments. For instance, all of the five example aspects recited above, i.e., the thirteenth through seventeenth examples aspects, may be combined with one another in some embodiments. As another example, any combination of two, three, or four of the five example aspects recited above may be combined in other embodiments. Thus, the example aspects recited above may be utilized in combination with one another in some example embodiments. Alternatively, the example aspects recited above may be individually implemented in other example embodiments. Accordingly, it will be understood that various example embodiments may be realized utilizing the example aspects recited above.

In another example embodiment, a ballistic garment includes a fabric hat with a rear bottom edge. The fabric hat is configured such that the rear bottom edge of the fabric hat covers an occipital ridge of the wearer when the fabric hat is on the wearer. The fabric hat is configured for receipt of an insert within an interior of the fabric hat. A plurality of hook and loop fastener patches are positioned on an outer surface of the fabric hat.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
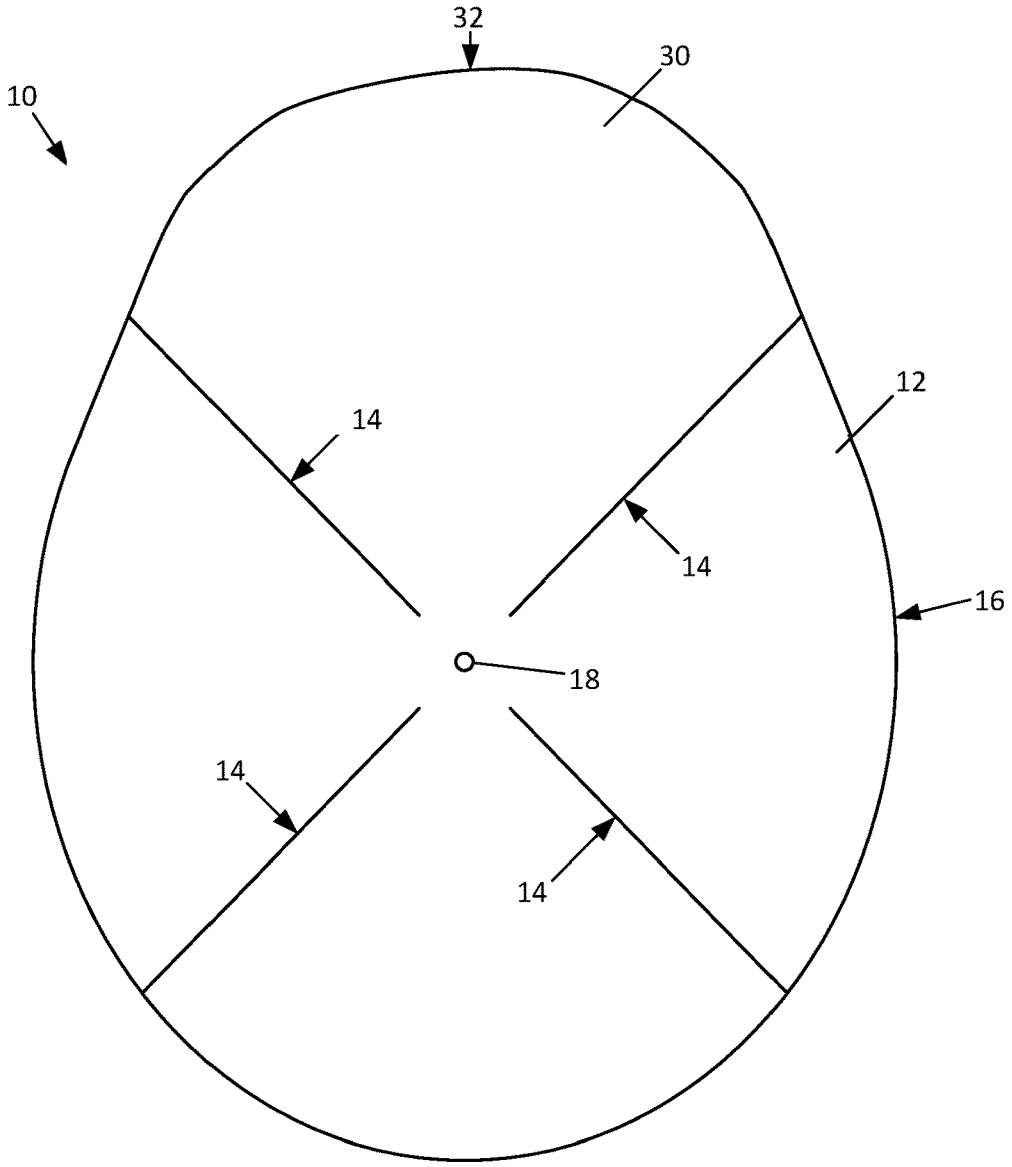
FIG. 1 is a top, plan view of a flexible ballistic sheet, in a flat configuration, according to an example embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

When introducing elements of the present disclosure or the preferred embodiment(s) thereof, the articles "a", "an", "the" and "said" are intended to mean that there are one or more of the elements. As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a ten percent (10%) margin.

Figure 2:
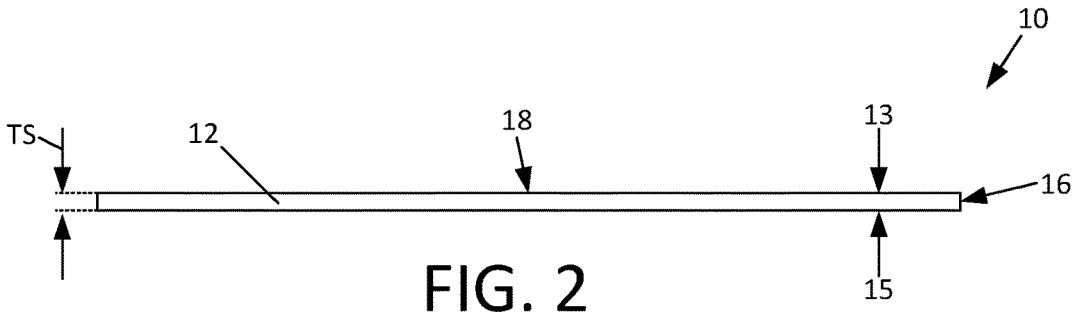
FIG. 2 is a side, elevation view of the example flexible ballistic sheet of FIG. 1.
Figure 3:
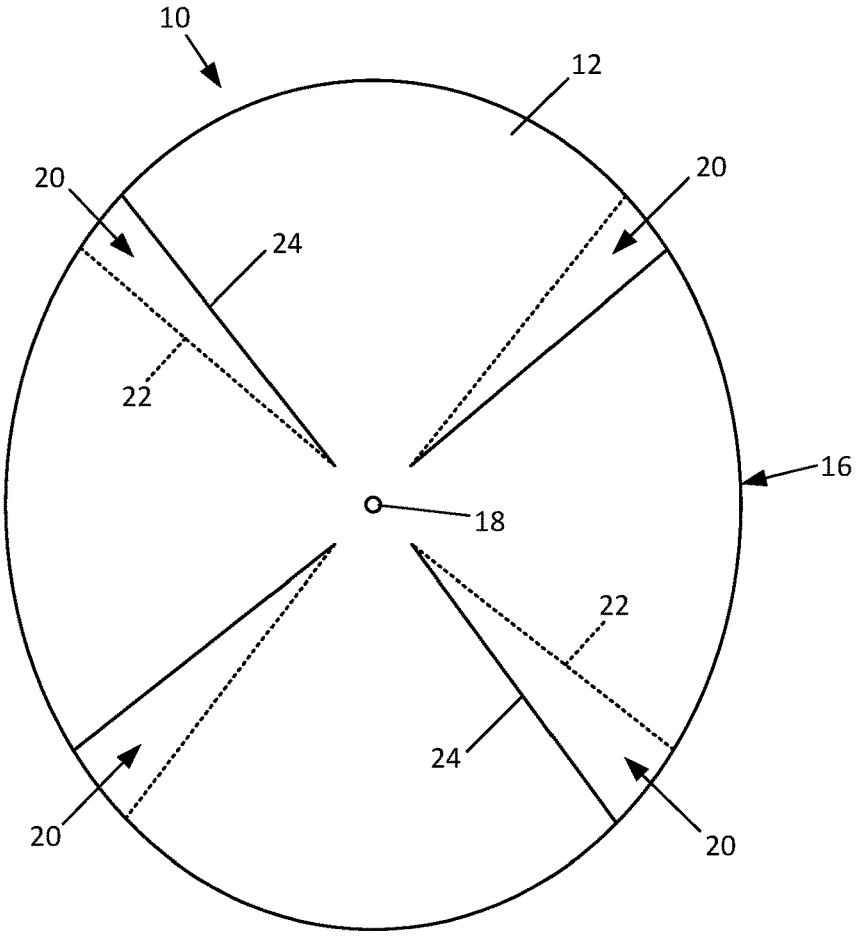
FIG. 3 is a top, plan view of the example flexible ballistic sheet of FIG. 1, in a folded configuration.
Figure 4:
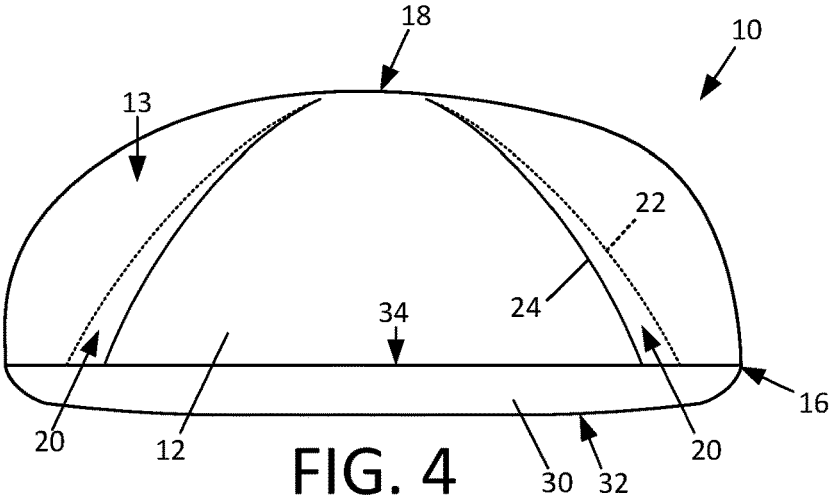
FIG. 4 is a side elevation view of the example flexible ballistic sheet of FIG. 3.

FIG. 1 is a top, plan view of a flexible ballistic sheet 10 according to an example embodiment of the present subject matter. In FIG. 1, flexible ballistic sheet 10 is shown in a flat configuration. Thus, e.g., as shown in FIG. 2, flexible ballistic sheet 10 may be generally planar in the flat configuration. Conversely, as shown in FIGS. 3 and 4, flexible ballistic sheet 10 may folded or deformed from the flat configuration, e.g., into a semispherical or other suitable shape. For instance, flexible ballistic sheet 10 may be folded from the flat configuration into a hat shape. As discussed in greater detail below, flexible ballistic sheets 10 may be stacked to form a flexible headcap 100 (FIG. 5) when flexible ballistic sheet 10 is in the folded configuration shown in FIGS. 3 and 4. Moreover, flexible ballistic sheet 10 may advantageously include features for forming the flexible headcap 100 without sizable gaps. Thus, flexible headcap 100 may be used as to protect the skull and brain of a wearer. For example, flexible headcap 100 may be worn alone or below a cap, hat, scarf, etc., and the flexible headcap 100 may limit or prevent projectiles from penetrating the skull so that underlying brain tissue is thereby protected.

Turning back to FIGS. 1 and 2, flexible ballistic sheet 10 may be formed from a fiber material that is resistant to penetration by projectiles, such as bullets. As an example, flexible ballistic panel 10 may be constructed of or with a fabric having one or more of ultra-high-molecular-weight polyethylene fibers and para-aramid fibers. In certain example embodiments, the ultra-high-molecular-weight polyethylene fibers may be Dyneema® or Spectra® brand fibers, and the para-aramid fibers may be Kevlar® brand fibers. The ultra-high-molecular-weight polyethylene fibers and para-aramid fibers may be woven together to form the flexible ballistic sheet 10. The fiber material within flexible ballistic sheet 10 may be more comfortable for extended wear relative to hard armor panels.

Flexible ballistic sheet 10 may have a circular or oval shape in the flat configuration. For example, flexible ballistic sheet 10 may be cut from a roll of ballistic fabric to form ballistic sheet 10 from the roll of ballistic fabric. Flexible ballistic sheet 10 may also include at least one slit 14. In the example embodiment shown in FIG. 1, ballistic sheet 10 includes four (4) slits 14. However, it will be understood that flexible ballistic sheet 10 includes other numbers of slits 14 in alternative example embodiments depending upon the desired shaped for flexible ballistic sheet 10 in the folded configuration. For example, flexible ballistic sheet 10 may include one (1) slit 14, two (2) slits 14, three (3) slits 14, five (5) slits 14, six (6) slits 14, or more.

Flexible ballistic sheet 10 may be cut to form slits 14. Slits 14 may extend from an outer edge 16 of flexible ballistic sheet 10 towards a center 18 of flexible ballistic sheet 10. Thus, e.g., flexible ballistic sheet 10 may be cut at the outer edge 16 towards the center 18 of flexible ballistic sheet 10 to form slits 14. Slits 14 may be straight or curved. For instance, slits 14 may be straight or curved from the outer edge 16 towards the center 18 of flexible ballistic sheet 10. A length of slits 14, e.g., from outer edge 16 towards the center 18 of flexible ballistic sheet 10 may be no less than twenty-five millimeters (25 mm) and no greater than one hundred and fifty millimeters (150 mm), such as no less than thirty millimeters (30 mm) and no greater than one hundred and twenty-five millimeters (125 mm), such as no less than fifty millimeters (50 mm) and no greater than one hundred millimeters (100 mm).

As shown in FIG. 1, flexible ballistic sheet 10 may have tail 30. The tail 30 may extend further from the center 18 of flexible ballistic sheet 10 than other portions of the flexible ballistic sheet 10. For instance, an edge 32 of the tail 30 may be disposed radially further from the center 18 of flexible ballistic sheet 10 than other edges of the flexible ballistic sheet 10.

As shown in FIG. 2, flexible ballistic sheet 10 may have a first surface 13 positioned opposite a second surface 15 on flexible ballistic sheet 10. Thus, first surface 13 may be spaced from second surface 15, and first surface 13 may also face opposite second surface 15 on flexible ballistic sheet 10. First and second surfaces 13, 15 may be spaced apart by a thickness TS of flexible ballistic sheet 10. The thickness TS of flexible ballistic sheet 10 may be no less than two hundred microns (200 μm) and no greater than six hundred microns (600 μm), such as no less than two hundred microns (200 μm) and no greater than six hundred microns (600 μm). The slits 14 may extend through the thickness TS of flexible ballistic sheet 10, e.g., between first and second surfaces 13, 15.

Turning to FIGS. 3 and 4, flexible ballistic sheet 10 is shown in the folded configuration. Flexible ballistic sheet 10 may be folded or deformed from the flat configuration into the folded configuration. For instance, flexible ballistic sheet 10 may have opposite edges 22, 24 at each slit 14, and the opposite edges 22, 24 at each slit 14 may be positioned in overlap to form an overlap joint 20 at each slit 14. By positioning the opposite edges 22, 24 at slits 14 in overlap the flexible ballistic sheet 10 may be curved in the folded configuration, e.g., rather than planar as in the in the flat configuration. For example, as shown in FIG. 4, semispherical or other suitable shape when the opposite edges 22, 24 at slits 14 are positioned in overlap to form the overlap joints 20. Thus, e.g., the overlap of opposite edges 22, 24 at slits 14 may be greater at the outer edge 16 of flexible ballistic sheet 10 than towards the center 18 of flexible ballistic sheet 10. In such a manner, flexible ballistic sheet 10 may be shaped to form headwear as discussed in greater detail below.

As shown in FIG. 4, tail 30 of flexible ballistic sheet 10 may extend downwardly such that tail 30 is positioned further from the center 18 of flexible ballistic sheet 10 than other portions of the flexible ballistic sheets 10. Moreover, the edge 32 of the tail 30 may be positioned below the front edge 34 of flexible ballistic sheets 10 when flexible ballistic sheet 10 are folded.

Figure 5:
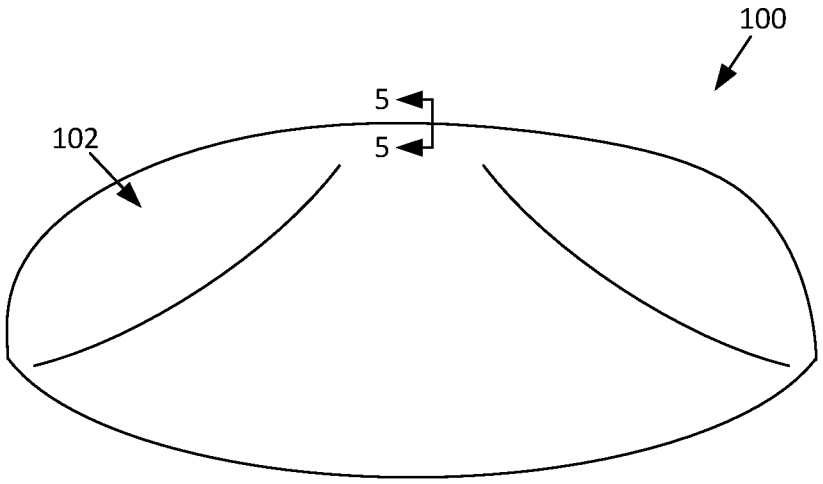
FIG. 5 is a perspective view of a flexible headcap formed from a plurality of the example flexible ballistic sheets of FIG. 3.
Figure 6:
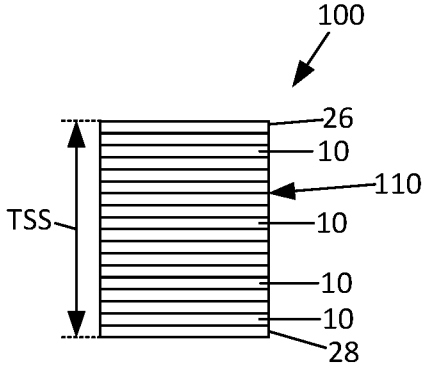
FIG. 6 is a section view of the example flexible headcap of FIG. 4 taken along the 5-5 line in FIG. 5.

Turning now to FIGS. 5 and 6, a plurality of flexible ballistic sheets 10 may be nested together and mounted to one another to collectively form a flexible headcap 100 from multiple flexible ballistic sheets 10. Moreover, each of the flexible ballistic sheets 10 may be in the folded configuration, e.g., such that the opposite edges 22, 24 at slits 14 are positioned in overlap to form the overlap joints 20 (FIGS. 3 and 4). Thus, as shown in FIG. 6, the flexible ballistic sheets 10 may be nested together in a stack 110.

The stack 110 of flexible ballistic sheets 10 may include a suitable number of flexible ballistic sheets 10. In example embodiments, the stack 110 of flexible ballistic sheets 10 may include no less than ten (10) flexible ballistic sheets 10, such as no less than twelve (12) flexible ballistic sheets 10, such as no less than fifteen (15) flexible ballistic sheets 10, such as no less than seventeen (17) flexible ballistic sheets 10, such as no less than twenty (20) flexible ballistic sheets 10. In example embodiments, the stack 110 of flexible ballistic sheets 10 may include no greater than thirty (30) flexible ballistic sheets 10, such as no greater than twenty-five (25) flexible ballistic sheets 10, such as no greater than twenty-two (22) flexible ballistic sheets 10, such as no greater than twenty (20) flexible ballistic sheets 10. Such number of flexible ballistic sheets 10 within the stack 110 may advantageously assist with limiting or preventing penetration of flexible headcap 100 by projectiles, such as bullets, while also providing comfortable protection during extended wear of flexible headcap 100, e.g., within a hat.

The stack 110 may have a thickness TSS between opposite end flexible ballistic sheets 10, e.g., between an outer flexible ballistic sheet 26 at an outer surface 102 of flexible headcap 100 and an inner flexible ballistic sheet 28 at an inner surface (not shown) of flexible headcap 100. The inner surface of flexible headcap 100 may face towards a wearer of flexible headcap 100, and the outer surface 102 of flexible headcap 100 may face away from the wearer of flexible headcap 100 when flexible headcap 100 is on the wearer. The thickness TSS of stack 110 (e.g., and thus flexible headcap 100) may be no less than two millimeters (2 mm) and no greater than twenty millimeters (20 mm), such as no less than three millimeters (3 mm) and no greater than fifteen millimeters (15 mm), such as no less than four millimeters (4 mm) and no greater than eight millimeters (8 mm). Such sizing of the TSS of stack 110 may advantageously provide comfortable protection during extended wear of flexible headcap 100, e.g., within a hat.

The flexible ballistic sheets 10 may be mounted together in a suitable manner to form the flexible headcap 100. For instance, flexible ballistic sheets 10 may be mounted together by adhesive or thermal bonding, such as by heating flexible ballistic sheets 10 such that adjacent flexible ballistic sheets 10 melt together. It will be understood that flexible ballistic sheets 10 may include a film over the woven ultra-high-molecular-weight polyethylene fibers and/or para-aramid fibers that may be melted together to heat bond the adjacent flexible ballistic sheets 10.

Flexible headcap 100 may be configured to protect against assaults with handguns and may also be suitable for extended daily wear. Thus, flexible headcap 100 may be worn by law enforcement officers while executing their daily duties. Flexible headcap 100 may provide three hundred and sixty degrees (360°) of head protection while also being comfortable to wear, e.g., relative to rigid helmets or other ballistic headwear.

Flexible headcap 100 may include multiple layers of strong, ballistic-resistant flexible sheets 10 that engage and deform a projectile in order to spreading a force of the projectile over a larger portion of flexible headcap 100, relative to an undeformed projectile. Flexible headcap 100 can absorb energy from the deforming projectile and stop the projectile before the projectile completely penetrates the flexible headcap 100. In certain example embodiments, flexible headcap 100 may conform to the NIJ Type IIIa standard and thus protect against penetration by the bullets described in such standard. Thus, e.g., flexible headcap 100 may stop .357 SIG and .44 Magnum ammunition fired from longer barrel handguns.

Figure 8:
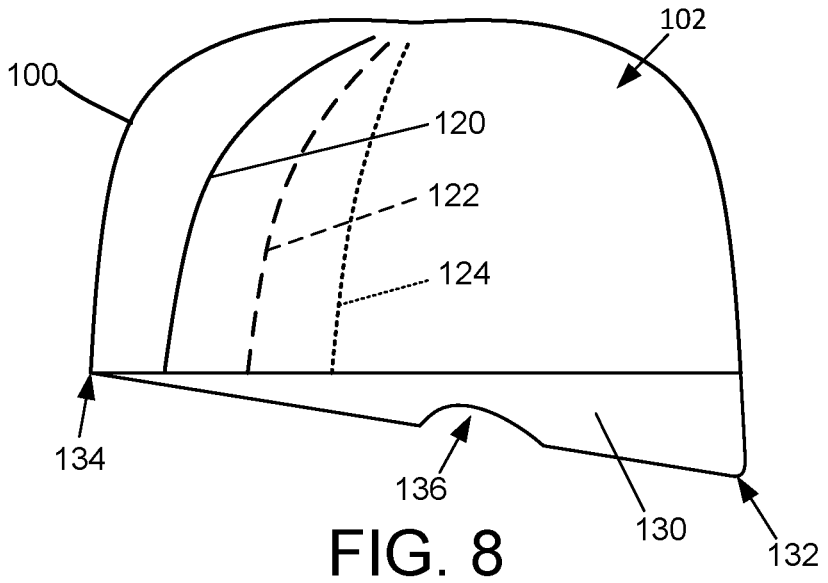
FIG. 8 is a side elevation view of a flexible insert according to an example embodiment of the present subject matter.

As shown in FIG. 8, flexible ballistic sheets 10 may also be oriented within flexible headcap 100 such that overlap joints 20 of adjacent flexible ballistic sheets 10 are offset or misaligned within flexible headcap 100. Thus, e.g., as shown in FIG. 8, an overlap joint 120 of a first one of flexible ballistic sheets 10 may be offset from an overlap joint 122 of a second one of flexible ballistic sheets 10 that is adjacent the first one of flexible ballistic sheets 10 within the stack 110. In addition, an overlap joint 124 of a third one of flexible ballistic sheets 10 may be offset from the overlap joint 122 of the second one of flexible ballistic sheets 10 that is adjacent the third one of flexible ballistic sheets 10 within the stack 110, e.g., and also offset from the overlap joint 120 of the first one of flexible ballistic sheets 10 within the stack 110. As an example, the overlap joints 20 of adjacent flexible ballistic sheets 10 may be offset by no less than fifty millimeters (50 mm), such as no less than twenty-five millimeters (25 mm), such as no less than ten millimeters (10 mm), e.g., at outer edges 16 of flexible ballistic sheets 10. Such relative positioning of the flexible ballistic sheets 10 within stack 110 may advantageously assist with limiting or preventing penetration of flexible headcap 100 by projectiles, such as bullets, e.g., by aligning the overlap joint 120 of each flexible ballistic sheet 10 with a continuous (non-slit) portion of adjacent flexible ballistic sheets 10.

Figure 7:
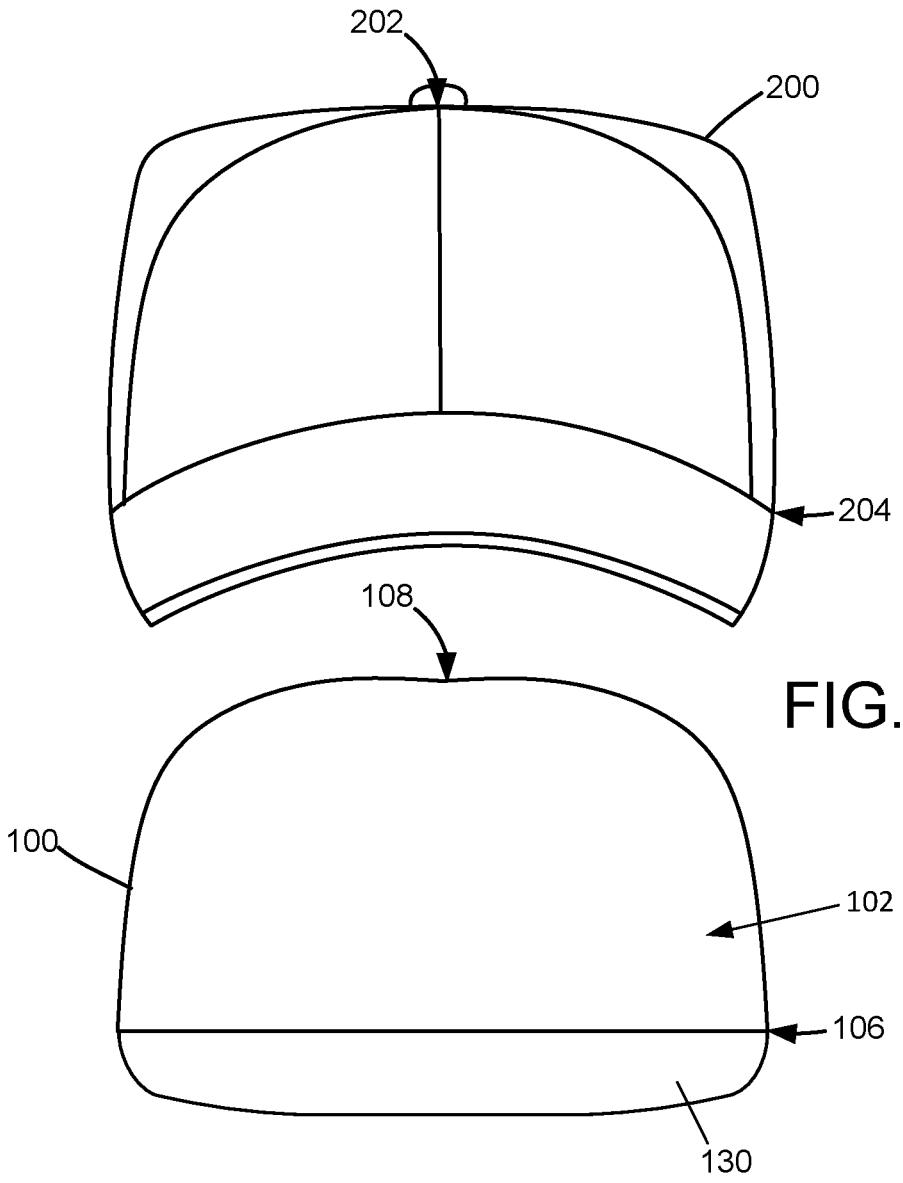
FIG. 7 is an exploded view of a fabric cap according to an example embodiment of the present subject matter with the example flexible headcap of FIG. 4 shown removed from an interior of the example fabric cap.

Flexible headcap 100 formed from flexible ballistic sheets 10 may be disposed within headwear in order to protect the skull and brain of a wearer. For example, as shown in FIG. 7, flexible headcap 100 may be disposed within headwear, such as a cap, hat, scarf, etc., and the flexible headcap 100 may prevent projectiles from penetrating the skull so that underlying brain tissue is thereby protected. In FIG. 7, a fabric hat 200 is shown. Flexible headcap 100 may be positioned within fabric hat 200. Moreover, a wearer may insert flexible headcap 100 within fabric hat 200. An interior of fabric hat 200 may be shaped complementary to flexible headcap 100. Moreover, an inner surface of fabric hat 200 may be shaped complementary to outer surface 102 of flexible headcap 100. Flexible headcap 100 in fabric hat 200 may protect a wearer of fabric hat 200 from brain damage due to projectiles, such as bullets.

Fabric hat 200 may be constructed to match the appearance of known headwear, such as a baseball cap, a casquette, a combination cap, a boonie hat, a patrol cap, a ranger hat, etc. Thus, e.g., fabric hat 200 may be constructed of various fabric panels stitched together. Fabric hat 200 may include one or more of para-aramid fibers, polyester fibers, cotton fibers, wool fibers, etc. As may be seen from the above, fabric hat 200 may have a covert and unassuming appearance. Thus, fabric hat 200 with flexible headcap 100 therein may be worn to provide protection from brain damage due to projectiles, such as bullets, while also avoiding the aggressive or militaristic appearance of known helmets.

Within fabric hat 200, a top portion 106 of flexible headcap 100 may be positioned adjacent a top portion 202 of fabric hat 200, and a bottom edge 108 of flexible headcap 100 may be positioned adjacent a bottom portion 204 of fabric hat 200. Thus, e.g., flexible headcap 100 may be distributed in a generally semi-spherical pattern within a corresponding portion of fabric hat 200. In particular, flexible headcap 100 may be distributed three-hundred and sixty degrees (360°) around an interior of fabric hat 200, e.g., in a plane that is perpendicular to an axis between the top and bottom portions 202, 204 of fabric hat 200. In such a manner, e.g., flexible headcap 100 may be positioned in fabric hat 200 to cover anterior, lateral and posterior skull bones when fabric hat 200 on a wearer.

As shown in FIG. 8, flexible headcap 100 may be removable from fabric hat 200. Thus, e.g., flexible headcap 100 may be removed from fabric hat 200 to allow cleaning of fabric hat 200, replacement of flexible headcap 100, etc. In alternative example embodiments, flexible headcap 100 may be attached to (e.g., sewn, adhered, riveted, etc.) fabric hat 200 such that flexible headcap 100 are not removable from fabric hat 200.

As may be seen in FIG. 8, flexible headcap 100 may include a rear bottom edge 132. The rear bottom edge 132 of the flexible headcap 100 may be sized and positioned such that the flexible headcap 100 extends to an occipital ridge of a wearer when the flexible headcap 100 is on the wearer. For instance, the rear bottom edge 132 of the flexible headcap 100 may be positioned lower than a front bottom edge 134 of the flexible headcap 100 along a vertical direction, e.g., when the flexible headcap 100 is oriented the manner corresponding to when the flexible headcap 100 is on the wearer. For example, the rear bottom edge 132 of the flexible headcap 100 may be positioned no less than a half inch (0.5") and no greater than four inches (4") lower than the front bottom edge 134 of the flexible headcap 100. For instance, the rear bottom edge 132 of the flexible headcap 100 may be positioned no less than one inch (1") and no greater than three inches (3") lower than the front bottom edge 134 of the flexible headcap 100. Such sizing may assist with allowing the flexible headcap 100 to comfortably cover the occipital ridge of some wearers.

As may be seen from the above, the flexible headcap 100 may cover vulnerable portions of the head, including up to where the spine meets the skull. Moreover, the positioning of the rear bottom edge 132 of the flexible headcap 100 may advantageously increase stability of the flexible headcap 100 on the wearer by engaging the occipital ridge. For instance, the rear bottom edge 132 of the flexible headcap 100 may tuck under the occipital ridge to assist with secure wearing of the flexible headcap 100 and thus allow greater movement and activity without undesirable movement of the flexible headcap 100 relative to the wearer.

As shown in FIG. 8, the flexible headcap 100 may define a pair of car notches 136 on opposite sides of the flexible headcap 100. The ear notches 136 may be positioned between the rear and front bottom edges 132, 134 of the flexible headcap 100. The car notches 136 may be positioned and shaped for receipt of the cars of a wearer when the flexible headcap 100 is on the wearer. The car notches 136 may allow for more comfortable wearing of the flexible headcap 100.

Figure 9:
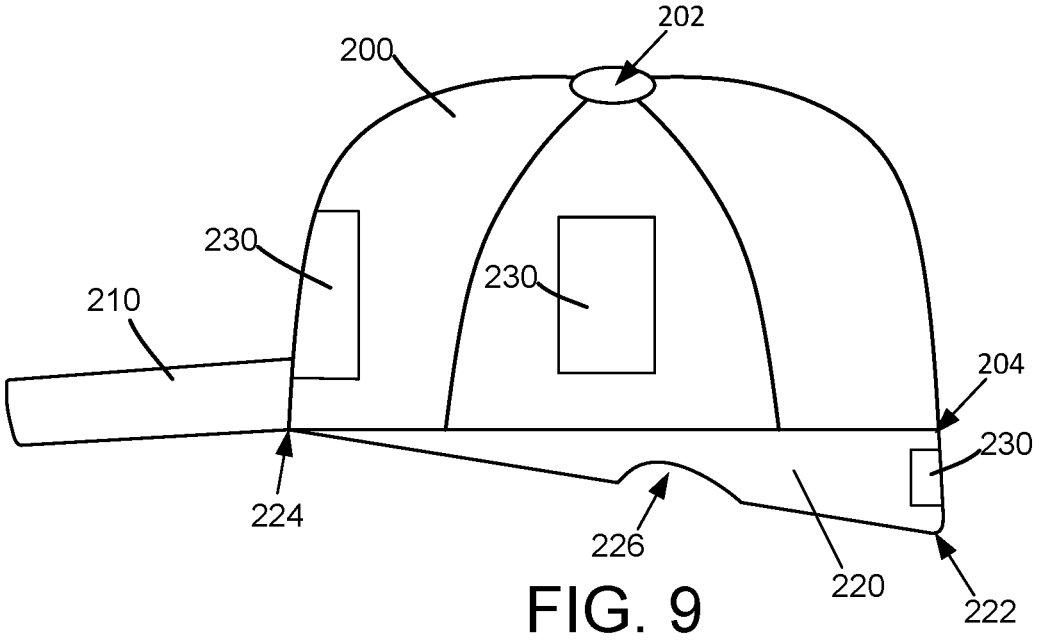
FIG. 9 is a side elevation view of a fabric hat according to an example embodiment of the present subject matter.

As may be seen in FIG. 9, fabric hat 200 may include a rear bottom edge 222. The rear bottom edge 222 of the fabric hat 200 may be sized and positioned to cover the rear bottom edge 132 of the flexible headcap 100. Thus, e.g., the rear bottom edge 222 of the fabric hat 200 may be sized and positioned such that the fabric hat 200 extends to the occipital ridge of the wearer when the fabric hat 200 is on the wearer. For instance, the rear bottom edge 222 of the fabric hat 200 may be positioned lower than a front bottom edge 224 of the fabric hat 200 along the vertical direction, e.g., when the fabric hat 200 is oriented the manner corresponding to when the fabric hat 200 is on the wearer. For example, the rear bottom edge 222 of the fabric hat 200 may be positioned no less than a half inch (0.5") and no greater than four inches (4") lower than the front bottom edge 224 of the fabric hat 200. For instance, the rear bottom edge 222 of the fabric hat 200 may be positioned no less than one inch (1") and no greater than three inches (3") lower than the front bottom edge 224 of the fabric hat 200. Such sizing may assist with allowing the fabric hat 200 to comfortably cover the occipital ridge of some wearers.

As shown in FIG. 9, the fabric hat 200 may define a pair of ear notches 226 on opposite sides of the fabric hat 200. The ear notches 226 may be positioned between the rear and front bottom edges 222, 224 of the fabric hat 200. The ear notches 226 may be positioned and shaped for receipt of the ears of a wearer when the fabric hat 200 is on the wearer. The ear notches 226 may allow for more comfortable wearing of the fabric hat 200. Each of the ear notches 226 of the fabric hat 200 may also align with a respective one of the ear notches 136 of the flexible headcap 100 when the flexible headcap 100 is received within the interior of the fabric hat 200.

A plurality of hook and loop fastener patches 230 may be positioned on an outer surface of the fabric hat 200. The hook and loop fastener patches 230 may be positioned on each panel of the fabric hat 200 and may be configured for mounting of patches, flashlights, cameras, strobes, beacons, Picatinny rails, etc. on the fabric hat 200. In example embodiments, hook and loop fastener patches 230 may include a one inch (1") by one inch (1") panel at a crown of the fabric hat 200, two inch (2") by three inch (3") panels on a front and sides of the fabric hat 200, and/or a one inch (1") by five inch (5") panel at a rear of the fabric hat 200. Wearers may thus mount accessories on the fabric hat 200, e.g., to allow handsfree use of such accessories on the fabric hat 200.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A ballistic headwear system, comprising:

a fabric hat; and an insert received within an interior of the fabric hat, the insert comprising a plurality of flexible ballistic sheets mounted together to collectively form the insert, the insert further comprising a rear bottom edge, the insert configured such that the rear bottom edge of the insert extends to an occipital ridge of a wearer when the insert is on the wearer, wherein each of the plurality of flexible ballistic sheets defines at least one slit, opposite edges of the plurality of flexible ballistic sheets at the at least one slit positioned in overlap such that each of the plurality of flexible ballistic sheets is curved, wherein the plurality of flexible ballistic sheets are nested together, and wherein the opposite edges of each of the plurality of flexible ballistic sheets defines an overlap joint, the plurality of flexible ballistic sheets are nested together in a stack, and the overlap joint of each of the plurality of flexible ballistic sheets is offset from the overlap joints of adjacent ballistic sheets within the stack of flexible ballistic sheets.

2. The ballistic headwear system of claim 1, wherein the fabric hat comprises a rear bottom edge, the fabric hat configured such that the rear bottom edge of the fabric hat covers the rear bottom edge of the insert.

3. The ballistic headwear system of claim 1, wherein the insert is removable from the interior of the fabric hat.

4. The ballistic headwear system of claim 1, wherein a thickness of the insert formed by the plurality of flexible ballistic sheets is no less than four millimeters and no greater than eight millimeters.

5. The ballistic headwear system of claim 1, wherein the plurality of flexible ballistic sheets comprises no less than fifteen flexible ballistic sheets.

6. The ballistic headwear system of claim 1, wherein each of the plurality of flexible ballistic sheets comprises ultra-high-molecular-weight polyethylene fibers.

7. The ballistic headwear system of claim 1, wherein the insert conforms to the National Institute of Justice Type Illa standard.

8. The ballistic headwear system of claim 1, wherein the insert formed by the plurality of flexible ballistic sheets covers anterior, lateral, and posterior skull bones as well as the occipital ridge when the insert is on a wearer.

9. The ballistic headwear system of claim 1, wherein the plurality of flexible ballistic sheets are distributed three-hundred and sixty degrees around the interior of the fabric hat.

10. The ballistic headwear system of claim 1, wherein the plurality of flexible ballistic sheets are mounted together by adhesive or thermal bonding.

11. The ballistic headwear system of claim 1, wherein the insert defines a pair of ear notches on opposite sides of the insert.

12. A ballistic garment, comprising:

a fabric hat comprising a rear bottom edge, the fabric hat configured such that the rear bottom edge of the fabric hat covers an occipital ridge of the wearer when the fabric hat is on the wearer; and an insert removably received within an interior of the fabric hat, the insert comprising a plurality of flexible ballistic sheets thermally bonded together to collectively form the insert, the insert further comprising a rear bottom edge positioned at the rear bottom edge of the fabric hat such that the rear bottom edge of the insert extends to the occipital ridge of the wearer when the insert is on the wearer, wherein each of the plurality of flexible ballistic sheets defines at least one slit, opposite edges of the plurality of flexible ballistic sheets at the at least one slit positioned in overlap such that each of the plurality of flexible ballistic sheets is curved, wherein the plurality of flexible ballistic sheets are nested together, and wherein the opposite edges of each of the plurality of flexible ballistic sheets defines an overlap joint, the plurality of flexible ballistic sheets are nested together in a stack, and the overlap joint of each of the plurality of flexible ballistic sheets is offset from the overlap joints of adjacent ballistic sheets within the stack of flexible ballistic sheets.

13. The ballistic garment of claim 12, wherein a thickness of the insert formed by the plurality of flexible ballistic sheets is no less than four millimeters and no greater than eight millimeters.

14. The ballistic garment of claim 12, wherein the plurality of flexible ballistic sheets comprises no less than fifteen flexible ballistic sheets.

15. The ballistic garment of claim 12, wherein the plurality of flexible ballistic sheets are distributed three-hundred and sixty degrees around the interior of the fabric hat.

16. The ballistic garment of claim 12, wherein the insert defines a pair of ear notches on opposite sides of the insert.

17. A ballistic garment, comprising:

a fabric hat comprising a rear bottom edge, the fabric hat configured such that the rear bottom edge of the fabric hat covers an occipital ridge of the wearer when the fabric hat is on the wearer;

a plurality of fastener patches positioned on an outer surface of the fabric hat; and an insert received within an interior of the fabric hat, the insert comprising a plurality of flexible ballistic sheets mounted together to collectively form the insert, the insert further comprising a rear bottom edge, the insert configured such that the rear bottom edge of the insert extends to an occipital ridge of a wearer when the insert is on the wearer, wherein each of the plurality of flexible ballistic sheets defines at least one slit, opposite edges of the plurality of flexible ballistic sheets at the at least one slit positioned in overlap such that each of the plurality of flexible ballistic sheets is curved, wherein the plurality of flexible ballistic sheets are nested together, and wherein the opposite edges of each of the plurality of flexible ballistic sheets defines an overlap joint, the plurality of flexible ballistic sheets are nested together in a stack, and the overlap joint of each of the plurality of flexible ballistic sheets is offset from the overlap joints of adjacent ballistic sheets within the stack of flexible ballistic sheets.

* * * * *